United States Patent [19]

Andrews et al.

[11] 3,966,060

[45] June 29, 1976

[54] LIFTING APPARATUS

[75] Inventors: John Frederick Collett Andrews, Lingfield; Roy Victor Beton, West Drayton; Kenneth David Leavens, Carpenders Park; Gordon John Scott, Bovingdon, all of England

[73] Assignee: Coal Industry (Patents) Limited, London, England

[22] Filed: Sept. 5, 1973

[21] Appl. No.: 394,528

[30] Foreign Application Priority Data

Sept. 15, 1972 United Kingdom ..... 42890/72

[52] U.S. Cl. ..... 214/35 R; 202/262; 212/4; 214/1 BC; 214/18 PH

[51] Int. Cl.[2] ..... B66C 13/00

[58] Field of Search ..... 214/18 PH, 35 R, 1 BC, 214/1 BH, 151; 212/4; 202/252, 262, 263

[56] References Cited

UNITED STATES PATENTS

| | | | |
|---|---|---|---|
| 3,007,097 | 10/1961 | Shelley et al. | 214/1 BC X |
| 3,142,391 | 7/1964 | Tweit | 214/18 PH |
| 3,731,822 | 5/1973 | Friesen et al. | 214/1 BC |
| 3,753,502 | 8/1973 | Abendroth | 214/18 PH X |

*Primary Examiner*—Robert G. Sheridan
*Attorney, Agent, or Firm*—James C. Wray

[57] ABSTRACT

Lifting apparatus which enables the lid of, for example a coke oven, to be removed during charging and then replaced has engagement means for the lid carried at the end of an arm. The arm is able to be raised and lowered and to be swung through an arc. The engagement means hook onto the lid or other object to be removed or replaced and the engagement means can oscillate at the end of the arm.

8 Claims, 2 Drawing Figures

LIFTING APPARATUS

Figure 1:
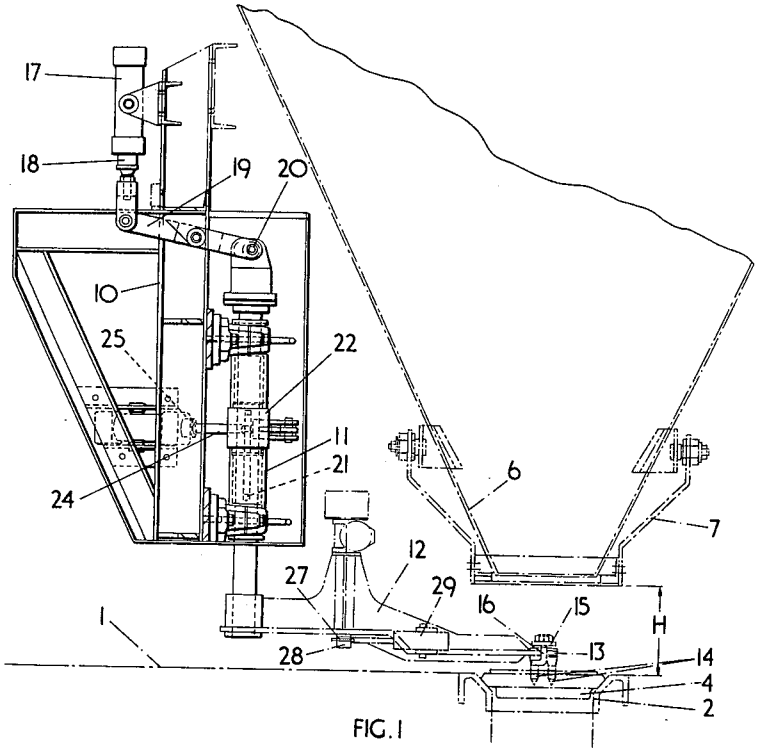

This invention relates to lifting apparatus for removing and replacing an object in a fixed location.

The invention is designed to have particular, although not exclusive application, to the removal of a lid from the top of a coke oven in order that the over may be charged and then to replace the lid after the charging.

In the particular application of the invention to coke ovens it is at present necessary for men to be on top of the ovens and to remove the lids in sequence so that a coal hopper and chute can be moved into position whereby coal to be coked can be fed into the oven. The lid then has to be replaced by the men who move on to lift the next lid. When the lid is removed noxious fumes can escape from the oven and these fumes can be detrimental to the men and if the lid is left removed for too long a period the escape of fumes can cause atmospheric pollution. Owing to the heat generated in the ovens due to the coking process, the men operating the lid lifting sequence have to work in very unpleasant conditions. It is thus desirable to arrange the lifting process so that men are not necessary at the top of the coke ovens and the lids are removed only for a minimum amount of time.

Machines have been devised which enable these lids to be lifted mechanically and these machines comprise an electro-magnet which attracts a steel plate on the top of the lid. The magnet is positioned over the lid and then energised to cause the lid to move on to the magnet. The magnet is then lifted with the lid and the lid is deposited on the top of the oven. The hopper to charge the oven can then be moved into position and the charge fed into the oven. Following this the hopper is removed and the lid lifted up again by re-energising the magnet and the lid and magnet are positioned over the coke oven aperture and the lid replaced by deenergising the magnet.

This machinery has substantial disadvantages. It is very expensive to construct and winding and insulation failures occur since the magnet is subjected to heat from the coke ovens as well as heat generated within the windings. As the lid is removed from the coke oven for a relatively long period the escape of noxious fumes occurs for a long period since it is necessary to deposit the lid so as to conserve energy by having the electro magnet constantly energised and also since time is consumed in moving the hopper into the charging position and out of the charging position. The size of the magnet is such that it cannot conveniently be located in between the hopper and the lid.

It is an object of the present invention to provide a simple and relatively inexpensive lid lifting device which has a very short degree of movement and which can be operated swiftly and conveniently.

According to the present invention lifting apparatus for removing and replacing an object in a fixed location includes an arm carrying at one end engaging means for the object to be lifted, rotating means for the arm, lifting and lowering means for the arm and further rotating means adapted to cause at least partial rotation of the engaging means.

The engaging means preferably includes a pair of prongs for engaging in apertures in the object. The engaging means may also include a member adapted to hook on to the object or to projections thereon.

A further rotating means may be provided which is adapted to oscillate the object in the lowered position of the arm and this oscillation may be through a small arc or a large arc.

The arm is preferably connected to a keyed or splined drive shaft and can be raised and lowered with the shaft by a fluid operated cylinder and if necessary a linkage mechanism attached to the drive shaft. A further fluid operated cylinder may be connected to the arm or to the drive shaft thereof to rotate the arm. The fluid operated clyinders may be pneumatically operated or, in certain applications, may be hydraulically operated.

In order that the invention may be readily understood one example of lifting apparatus for removing and replacing the lid of a coke oven during charging of the oven will now be described with reference to FIGS. 1 and 2 of the accompanying drawings. In the figures, FIG. 1 is a side view and FIG. 2 a top plan view of the apparatus.

Figure 2:
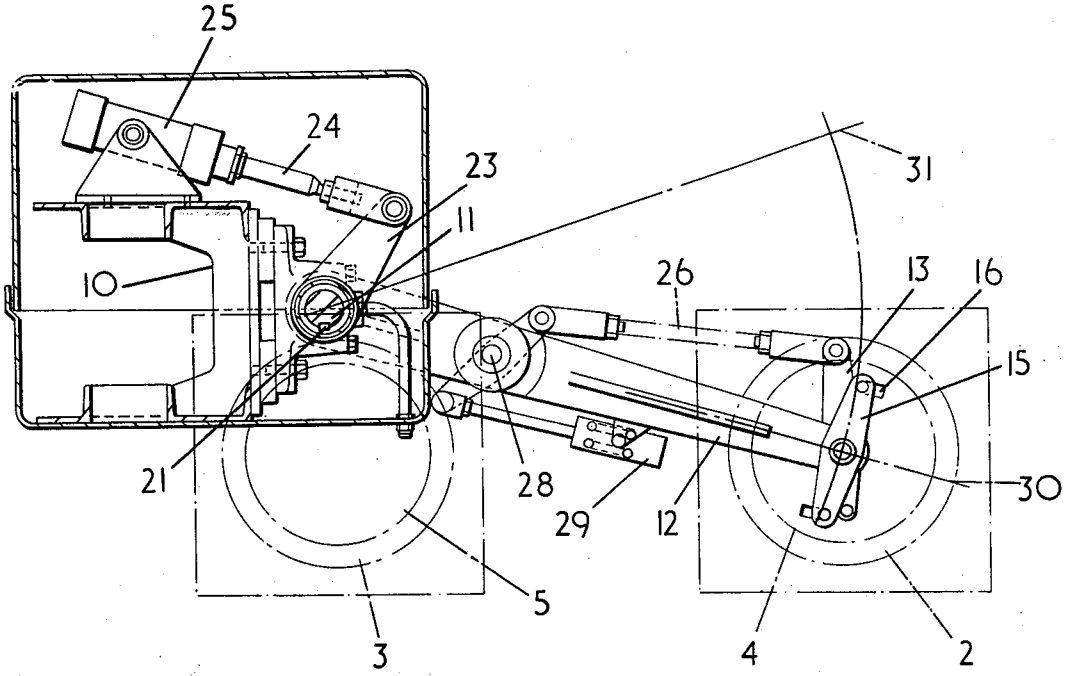

Referring now to the drawings a horizontal coke oven 1 is shown having two feed apertures 2 and 3 in the top surface (FIG. 2). There are in fact four or more apertures for charging along the oven but only two are shown in the drawings. The ovens are charged by a sequential charger which travels over a battery of ovens and is arranged to feed predetermined amounts of coal into the ovens in a sequence by removing the lids of the ovens and then feeding coal from hoppers positioned above the ovens. The whole operation is controlled by an operator situated in an air conditioned cab on the charger and effecting control through an automatic push button sequential controller.

The apertures 2, 3 have lids 4, 5 respectively and one of the hoppers 6 can be seen in FIG. 1 positioned above the lid 4 and aperture 2. The outlet from the hopper 6 is controlled by outlet gates 7. The mouth of the hopper 6 is positioned a distance H above the top of the oven 1.

The lid lifting apparatus comprises a frame 10 which supports a vertical and rotatable shaft 11 which carries at its lower end a cantilevered arm 12 which is securely fixed to the bottom of the shaft 11. The arm 12 carries at its free end a bar 13 which comprises engaging means and has two downwardly depending prongs 14. A further bar 15 extends across the end of the arm 12 and carries two downwardly projecting hooks 16.

Connected to the top of the frame 10 is a vertically mounted pneumatically operated pressure regulated cylinder 17 having a piston rod 18 which is pivotally connected to a cross lever 19 fitted with an adjustable counterbalance weight mounted on the frame 10. The other end of this lever 19 is connected to a pivotal point 20 at the top of the shaft 11.

The shaft 11 is provided with a key 21 and is vertically mounted to slide in a bearing collar 22. This shaft has a crank arm 23 connected to it and to the end of a piston rod 24 of a cylinder 25. The cylinder 25 is connected to the frame 10.

The engaging means 13 has a link arm 26 connected through one end of a centrally mounted lever 27 to a pneumatic oscillating cylinder 28 which provides the oscillation of engaging bar 13. The other end of lever 27 is connected to a spring return device 29 attached to the arm 12 to ensure correct positioning of prongs 14.

In operation the hopper 6 is charged with a required quantity of coal to be coked and is positioned by an operator over the aperture 2 of the coking oven 1. The arm 12 is positioned as shown in FIG. 2 with the prongs 14 engaging in apertures in the lid 4. A stop pin with a rotatable collar rests on the centre of the lid and correctly positions the height of arm so that the prongs may engage effectively. The oscillating cylinder is then operated to move the rod 26 towards the lid 4 and to cause the bar 13 of the engaging means to pivot through a small arc about the end of the arm 12. This in turn causes the prongs 14 to pivot lid 2 until the hooks 16 on bar 15 engage under bars (not shown) secured to the top of the lid 2.

The cylinder 17 is now operated to move the piston 18 downwards and this causes the lever 19 to pivot and to raise the pivotal point 20 where it is connected to the shaft 11. As a consequence shaft 11 rises lifting the arm 12 a distance which is less than the height H. The key 21 slides in the bearing 22. When the arm 12 has been fully raised the lid 4 is clear of the top of the oven 1 and the cylinder 25 is now operated to draw in the piston 24 causing the crank 23 to rotate the shaft 11 and the arm 12. The arm 12 thus moves from a position with its centre line on the line 30 to a position with its centre line on the line 31.

As soon as the arm has reached the position shown by line 31 with the lid free of the aperture 2 the hopper gates 7 are opened and coal discharges from hopper 6 through the aperture 2 in to the oven. As soon as the discharge from the hopper 6 is complete the cylinder 25 is again operated this time extending the piston 24 and causing the shaft 11 to rotate and the arm 12 to swing back to the position of the line 30 with the lid 4 in position over the aperture 2. Cylinder 17 is now operated to draw in piston 18 causing the shaft 11 to lower the arm and to locate the lid 4 on the inclined mouth of the aperture 2 and exert a small amount of adjustable downward pressure. When the lid 4 is fully lowered the oscillating cylinder 28 is operated a number of times to withdraw and extend the rod 26. This action causes the lid to be moved forwards and backwards in a circular movement over a small arc and helps it to bed down in the mouth of the aperture 2 crushing in any small pieces of coal which have been lodged there following the charging action to form a seal.

The charging is now complete and it will be appreciated that the charge thus has been made very swiftly and the lid has only been removed for a short period thus minimising the quantity of noxious fumes which might escape. Since the lid has been able to be lifted with the hopper in position and the lid has been held in a raised position, no time has been lost in closing the aperture once charging has taken place and while the hopper is moved into the position or out of position.

The use of pneumatic cylinders gives the advantage that there is no fire risk from leaking hydraulic oil coming into contact with hot surfaces.

We claim:

1. Lifting apparatus for lifting and lowering an object comprising an arm having at one end a pivot, engagement means including a bar mounted on the pivot with prongs fixed on the bar and projecting downward from the bar adapted to engage with the object, a drive shaft for the arm connected adjacent the other end of the arm, lifting and lowering means connected with the drive shaft for lifting and lowering the drive shaft and the arm, first rotating means separately connected to the drive shaft for rotating the drive shaft and the arm, and second rotating means connected to the arm and engagement means for relatively rotating the engagement means about the pivot with respect to the arm.

2. Lifting apparatus according to claim 1 and the engagement means including a second bar fixed on the arm with fixed hook members on the second bar adapted to engage with the object.

3. Lifting apparatus according to claim 1 further comprising a collar slidable along the drive shaft and keyed to the drive shaft to be rotatable therewith and in which the first rotating means comprises a piston and cylinder arrangement, connected with the collar whereby rotation of the collar under action of the piston and cylinder arrangement causes rotation of the drive shaft.

4. Lifting apparatus according to claim 1, in which the second rotating means comprises an oscillating cylinder connected between the arm and the engagement means.

5. Lifting apparatus according to claim 4, in which a spring return device is linked to the bar mounted on the pivot.

6. Lifting apparatus in a coke oven installation comprising a battery of coke ovens, each having a charging lid on the top thereof, and a movable charging device including a hopper having lower gates through which a charge of coal is adapted to pass into the coke ovens, in which the lifting apparatus includes engagement means having prongs for locating in the lid and having hook members engaging in projections in the lid, an arm carrying the engagement means, the arm being connected to a drive shaft, a piston and cylinder arrangement connected to the shaft for raising and lowering the drive shaft and associated arm and engagement means, a first rotating means adapted to cause rotation of the drive shaft, and second rotating means connected between the arm and the engagement means adapted to rotate, at least partially, the engagement means.

7. The lifting apparatus of claim 1 wherein the engagement means comprises a bar horizontally turnable on a vertical pivot on a distal end of the arm, spaced from the shaft, and the prongs are mounted on the bar and extending downward for engagement with depressions in a lid, whereby engaging the depressions with the prongs and turning the bar turns the lid.

8. The lifting apparatus of claim 7 wherein the engagement means further comprises a second bar mounted on the arm, with hooks extending downward and outward from the second bar for engaging projections on the lid, whereby turning the lid with the prongs causes projections on the lid to engage and disengage the hooks.

* * * * *